US006175635B1

(12) United States Patent
Meyer et al.

(10) Patent No.: US 6,175,635 B1
(45) Date of Patent: Jan. 16, 2001

(54) HEARING DEVICE AND METHOD FOR ADJUSTING AUDIOLOGICAL/ACOUSTICAL PARAMETERS

(75) Inventors: Wolfram Meyer, Moehrendorf; Ullrich Sigwanz, Hausen; Hans-Joachim Weiss, Nuremberg, all of (DE)

(73) Assignee: Siemens Audiologische Technik GmbH, Erlangen (DE)

( * ) Notice: Under 35 U.S.C. 154(b), the term of this patent shall be extended for 0 days.

(21) Appl. No.: 09/190,700

(22) Filed: Nov. 12, 1998

(30) Foreign Application Priority Data

Nov. 12, 1997 (DE) ..... 197 50 140
Sep. 24, 1998 (DE) ..... 198 43 907

(51) Int. Cl.[7] ..... H04R 25/00

(52) U.S. Cl. ..... 381/314; 381/60; 381/312; 73/585; 600/559

(58) Field of Search ..... 381/60, 312, 314, 381/320, 321, 323; 73/585; 600/559

(56) References Cited

U.S. PATENT DOCUMENTS 4,792,977 * 12/1988 Anderson et al. ..... 381/314
4,947,433 * 8/1990 Gebert ..... 381/314
5,515,443 * 5/1996 Meyer ..... 381/312
5,604,812 * 2/1997 Meyer ..... 381/312

FOREIGN PATENT DOCUMENTS

OS 196 25 639 1/1998 (DE) .
0 341 997 11/1989 (EP) .
0 389 825 10/1990 (EP) .

* cited by examiner

*Primary Examiner*—Curtis A. Kuntz
*Assistant Examiner*—Suhan Ni
(74) *Attorney, Agent, or Firm*—Schiff Hardin & Waite

(57) ABSTRACT

A hearing device has a microphone, a signal processor, an earphone and a number of externally accessible final control elements for setting audiological/acoustical parameters of the signal processor. An allocation stage is connected between the signal processor and the final control elements for allowing a number of combined and/or derived parameters to be simultaneously set by actuation of a single final control element.

30 Claims, 4 Drawing Sheets

HEARING DEVICE AND METHOD FOR ADJUSTING AUDIOLOGICAL/ACOUSTICAL PARAMETERS

BACKGROUND OF THE INVENTION

1. Field of the Invention

The present invention is directed to a hearing device of the type worn at the ear, i.e., behind the ear or in the ear, as well as to a method for adjusting audiological/acoustic parameters in such a hearing device.

2. Description of the Prior Art

Hearing aids are known wherein individual audiological/acoustical parameters are set directly by individually allocated final control elements. The space available at the hearing device for non-overlapping or interfering placement of final control elements, however, is limited and decreases with increasing miniaturization of the hearing devices.

SUMMARY OF THE INVENTION

An object of the present invention is to provide a hearing device and a method for the adjustment of audiological/acoustical parameters wherein an arbitrary number of audiological/acoustical parameters can be set via final control elements. As used herein a "final control element" is an element which is actuated in some manner to set or change one or more parameters such as, for example, manually operable, externally accessible element such as push buttons or thumb wheels or switches, or telemetrically operated switches, or remote signal receivers. Reference to a final control element as being "actuated" or "actuatable" therefore encompasses manual or electronic actuation.

The above object is achieved in an inventive hearing device having an allocating stage for combining and/or deriving audiological/acoustical parameters, whereby a number of combined and/or derived parameters can be set simultaneously by activating only one final control element. The number of the final control elements at the hearing device thus can be reduced, since a number of correspondingly combined or derived audiological/acoustical parameters can be simultaneously set by actuation of one final control element. Of course, it is still possible to actuate more than one final control element, with each actuated final control element simultaneously setting a number of parameters which have been differently combined and/or derived in the allocation stage.

Given the combining of a correspondingly large number of parameters, a very large number of parameters can thus be set by a low number of final control elements.

Besides combining parameters, the individual parameters can also be linked, and correspondingly derived parameters can be obtained by intermediate (computing) operations. The number of parameters that can be set via the final control elements can also be increased in this way.

The inventive hearing device enables the simultaneous adjustment of a number of parameters (e.g. total amplification and treble amplification) via a single final control element without the need for space for two final control elements at the hearing device or the need to the individually actuate two individual final control elements.

The combination and/or derivation of the parameters to the individual final control elements which takes place in the allocating stage can be changeable in order to respectively allocate groups of combined and/or derived parameters to the respective individual final control elements, these groups being respectively adapted on the basis of the current hearing situation or of changing hearing conditions of the user.

In an embodiment employing a programmable allocating stage, the allocation of the individual parameters to the final control elements can occur in program-controlled fashion. User-specific allocations can be utilized therein.

In an another embodiment the inventive hearing device has a detector element for the detection of current useful signals and noise signals. Following an evaluation of the detected useful and noise signals, corresponding combinations and/or derivations of parameters to the final control elements can then be performed, these parameters being adapted to the current hearing situation.

If, for example, the user frequently spends time in traffic, this can be taken into account in the combination of the individual parameters subsequent to a detection by the detector element. In this connection the total amplification, the bass AGC element and the treble AGC element could be allocated to a single final control element.

Given increasing adjustment of the final control element the basic amplification and the amplification by the treble AGC element could thus increase, while the bass AGC element (for cutting out low-frequency noises such as car noise) is simultaneously lowered.

In connection with the detector element a combination of individual parameters can thus ensue, this combination being adapted to the specific hearing situation, whereby it is simultaneously established whether, given an increasing adjustment of the final control element, the combined parameters are adjusted to the same or to different degrees, and in the same or opposite directions.

In a further embodiment the audiological/acoustical parameters can also be adjusted via an external unit (i.e. not directly at the hearing device), with the external unit can being connectable to the hearing device via a cable connection or via an interface.

Adjustment via an external unit can prove to be advantageous given a recalibration or overhaul of the hearing device at an acoustician's or by the manufacturer, since other operating elements and potentially auxiliary programs can also be integrated in the external unit.

The allocating stage for the combination and/or derivation of parameters to the individual final control elements can be integrated in the hearing device or even in the external unit.

The allocating apparatus itself can be implemented as storage unit, preferably as non-volatile memory, whereby a number of parameter variables can be allocated to the respective memory addresses, and/or combined parameter values can be allocated to respective memory addresses.

In the inventive method for the adjustment of audiological/acoustical parameters, these parameters are initially combined and/or derived and are set via a few final control elements. A large number of parameters can thereby be set by a low number of final control elements.

The combination and/or derivation of the parameters is preferably adjustable so that an adaptation to current hearing situations or changing hearing habits of the user can occur.

In another variation of the method a combining and/or derivation of parameters which is adapted to the current hearing situation can occur subsequent to a detection and evaluation of current useful signals and noise signals, so that a comfortable adaptation of the signal processing in the hearing device to the current hearing situation can take place via the existing final control elements.

A combination and/or derivation of the parameters of the signal processor its components preferably ensues, such as the PC (peak clipping) element, the preamplifier, the separating filter, the bass AGC, the treble AGC, the treble amplifier and/or the bass amplifier.

In a digital hearing device individual signal processing procedures preferably are combined and/or differentiated, allowing a number of signal processing algorithms to be simultaneously activated in the executed connection and linkage via individual final control elements.

The allocation of the final control elements to the components of the signal processing apparatus preferably ensues via a memory unit/decoder unit. The addresses for the memory unit/decoder unit are generated by a linking or combination of the digitized values of the final control elements. The data words filed under these addresses control the signal processing apparatus.

In the embodiment described above an external EDP (electronic data processor) unit is commonly utilized for the basic programming/reprogramming of user-specific parameters (groups of parameters). It is also an object of the invention to provide a hearing device and a method for the basic programming/reprogramming of user-specific parameters (groups of parameters) which do not include an external EDP.

Such a hearing device has an integrated generator (or synthesizer) with a generator control. In the basic programming/reprogramming of the hearing device tone signals, noise signals or noise pulse signals can be generated via this signal generator. In "in-situ programming" the user can demonstrate to the acoustician when signals generated by the acoustician by the actuation of control elements are heard and/or experienced as comfortable.

User-specific parameters (groups of parameters) for signal processing in the hearing device (e.g. amplification in the individual channels, AGC settings, dynamic values, discomfort thresholds, etc.) thus can be gradually set. "In-situ programming" takes place while the microphone is disconnected.

Due to the built-in generator of the hearing device an external EDP for the importing of adjustment programs into the hearing device in the basic programming/reprogramming is not needed. A setting of user-specific parameters (groups of parameters) is thus particularly simplified if such an EDP is not available for reasons of cost (e.g. in developing countries).

An external unit for basic programming/reprogramming of the hearing device can be advantageously provided via which other final control elements (trimmers) and the control element for the signal generator control can be actuated by the acoustician. The inventive hearing device can additionally have a programming jack in order to enable supplementary programming by means of an external EDP.

A significant advantage of this embodiment is that the acoustician can compute and/or set parameter groups which are different and which are adjustable in their allocation via a few control elements without using an external EDP. According to the appertaining method a basic programming/reprogramming of user-specific parameters (groups of parameters) takes place via a few final control elements via a signal generator with generator control, this signal generator being integrated into the hearing device. Various signals and levels are generated via the signal generator, these signals being classified by the user as audible and/or comfortable. Substantially, the aforementioned user-specific parameters (groups of parameters) and characteristic values can be set gradually at the hearing device for basic programming/reprogramming.

A setting of the characteristic values and parameters preferably ensues gradually at different levels of the output signal of the generator. Furthermore, via an external unit a combined and bundled arrangement and setting of final control elements and control elements for the generator for basic programming/reprogramming can be realized without an external EDP.

In addition the inventive arrangement also allows a basic programming/reprogramming using a connectable external EDP temporarily connected via a programming jack.

DESCRIPTION OF THE PREFERRED EMBODIMENTS

Figure 1:
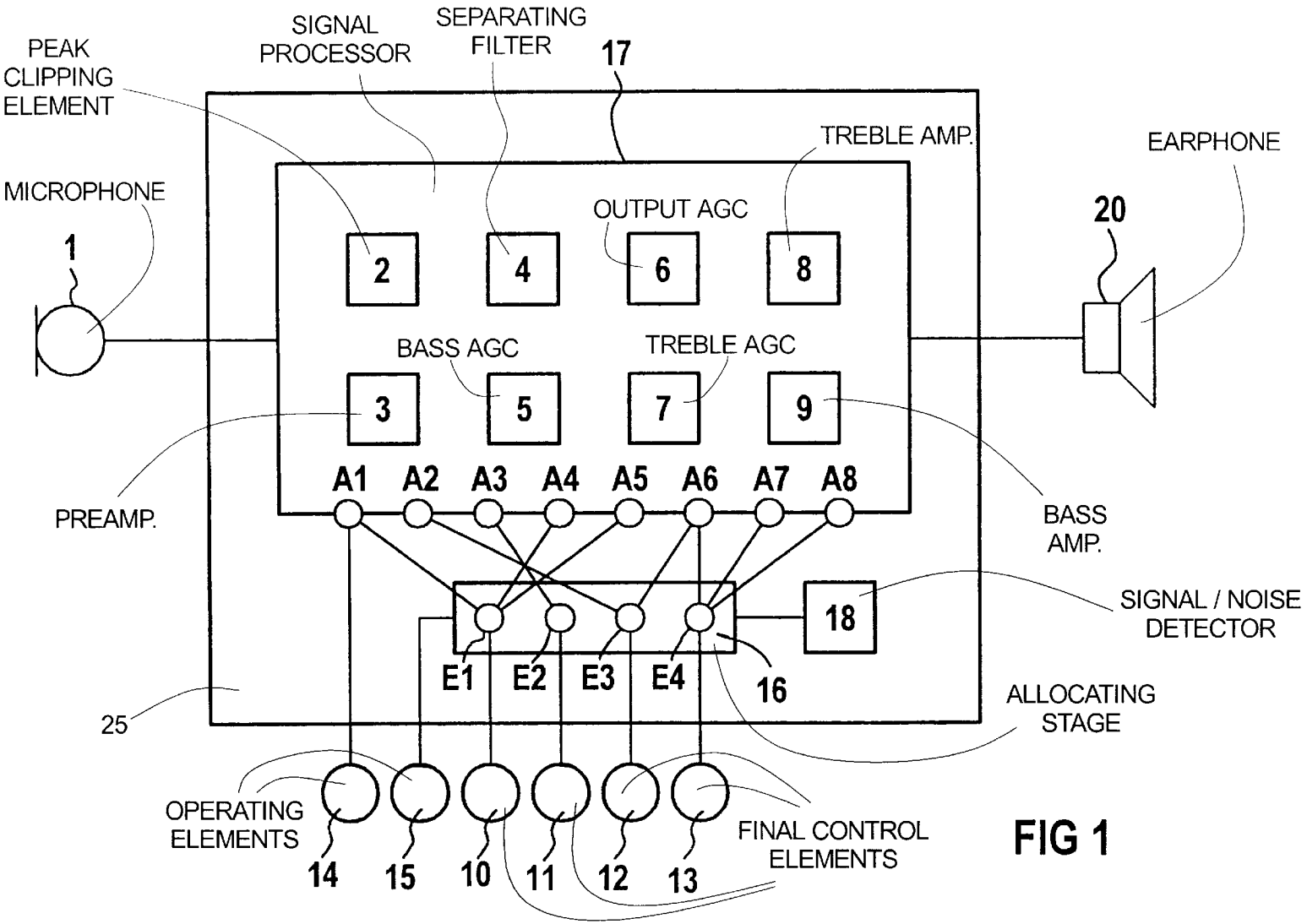
FIG. 1 is a block diagram of an embodiment of an inventive hearing device with an internal allocating stage.

FIG. 1 depicts a hearing device having a housing 25 allowing the hearing device to be worn at the ear of a user. Thus the housing 25 can be of a type allowing placement in the ear of a type allowing placement behind the ear. The hearing device has a microphone 1, a signal processor 17 and an earphone 20. Individual signal processing elements are schematically shown (i.e., without specific electrical interconnections) in the signal processor 17 as examples, namely a PC element 2 (Peak Clipping element), a preamplifier 3, a separating filter 4, a bass AGC 5, an output AGC 6, and a treble AGC 7, as well as a treble amplifier 8 and a bass amplifier 9.

The hearing device further has an allocating stage 16 for the combination and/or derivation of audiological/acoustic parameters of the elements 2–9 of the signal processor 17.

For actuation of the elements of the signal processing chain 17, output contacts A1–A8 are connected directly to the individual elements 2–9. The output contacts A1–A8 of the signal processor 17 can now be connected individually and basically arbitrarily to the input contacts E1–E4 of the allocating stage 16, and thus to their final control elements 10–13 via the allocating stage 16. The final control elements 10–13 (and all other final control elements described herein) are manually or electronically accessible and actuatable externally of the housing 25.

From FIG. 1 it can be seen that the outputs A1, A4, A5 are connected to the input E1, the outputs A2 and A6 are connected to the input E3, output A3 is connected to the input E2, and the outputs A6,A7,A8 are connected to the input E4 of the allocating stage 16.

An activation of the elements of the signal processor 17 connected to the outputs A1, A4, A5 thus ensues simultaneously given the actuation of the final control element 10.

The allocation between the outputs A and inputs E is adjustable (changeable) and can be adapted to current hearing situations or user desires. Individual outputs A can also be connected to a single input (e.g. connection A2–E3), or individual outputs can be connected to a number of inputs (e.g. A6 to E3 and E4).

In general, by means of the allocating stage 16 not only can a connection ensue between outputs A and inputs E, but also the audiological/acoustical parameters allocated to the outputs A can also be weighted, averaged or otherwise processed by other (computing) operations before a combination of the resultant differentiated parameters ensues.

The hearing device can have other operating elements 14, 15 besides the final control elements 10–13.

Current noise and/ or useful signals can be picked up via a detector element 18, and the allocation between the outputs A and the inputs E can also be adapted to the current hearing situation dependent on the detected noise and/or useful signals.

Figure 2:
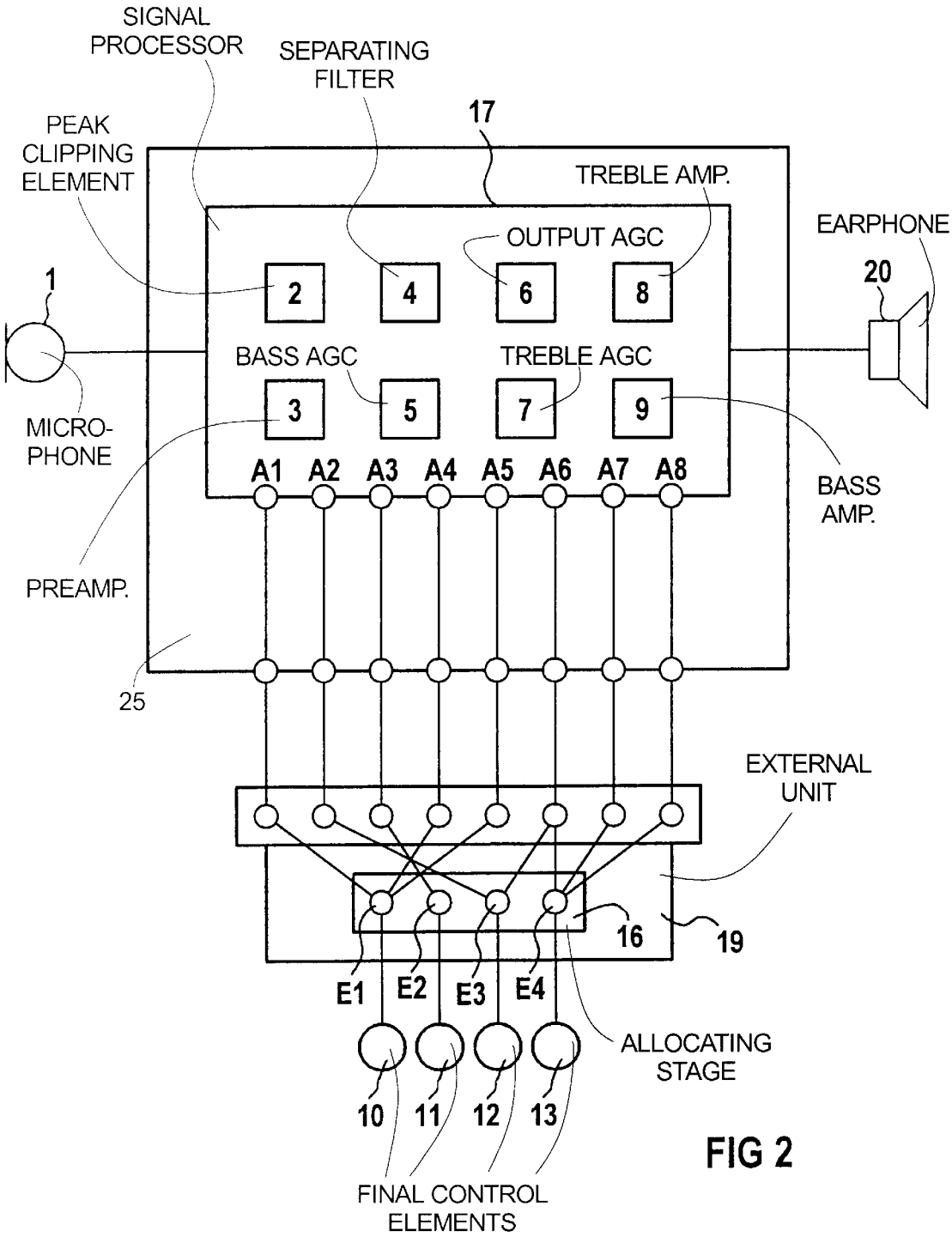
FIG. 2 is a block diagram of an embodiment of an inventive hearing device with an allocating stage integrated in an external unit.

FIG. 2 depicts a hearing device with an allocating stage 16 integrated into an external unit 19. Differing from the embodiments of FIG. 1, the allocating stage 16 thus is not integrated in the hearing device itself.

Using the final control elements 10–13 the acoustician can perform a corresponding combination and/or derivation of the audiological/acoustic parameters via the external unit 19 and can preform a comprehensive combination and/or derivation of audiological/acoustic parameters of the hearing device via other operating elements (possibly integrated in the external unit 19) as well as using EDP programs (not depicted), for example.

Figure 3:
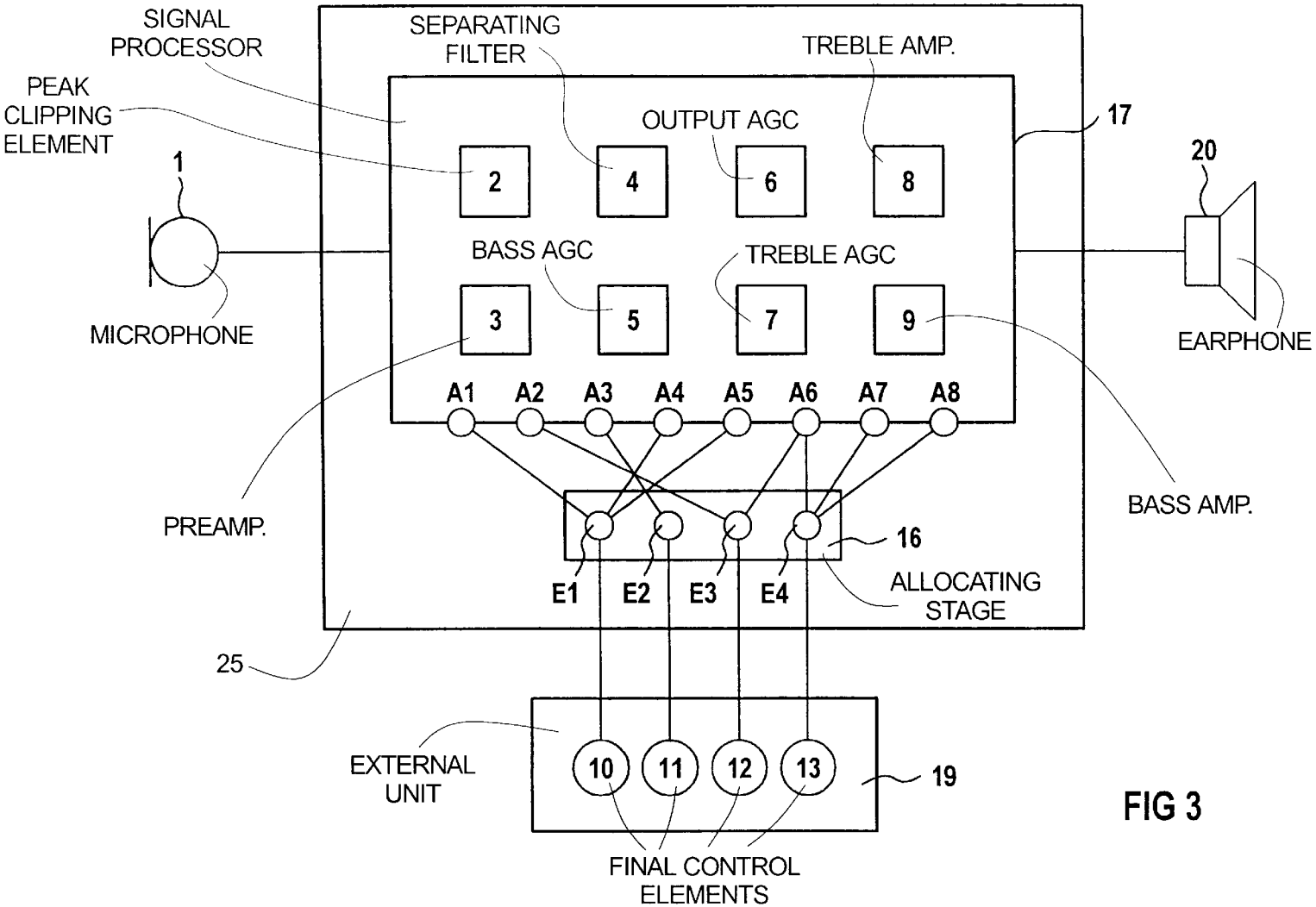
FIG. 3 is a block diagram of an embodiment of an inventive hearing device with internal allocating stage and external control unit.

FIG. 3 depicts an external unit 19 with final control elements 10–13 for setting parameters of the outputs A1–A8 which are connected directly to one of the elements 2–9 of the signal processor 17, respectively, these parameters having been combined and/or derived in an internal allocating stage 16 at the inputs E1–E4. The external unit 19 does not contain an allocating stage 16 and can be constructed in compact fashion, accordingly. Compared to the hearing aid-mounted arrangement of the final control elements 10–13, added possibilities result from the external unit 19 by allowing additional final control elements or other operating elements in order to be able to individually set the audiological/acoustical parameters which are combined and/ or derived in the allocating stage 16.

Virtual/visual controllers can be offered to the user via the external unit 19, for example. The combining and derivation of the parameters is then completed in the external unit 19.

Figure 4:
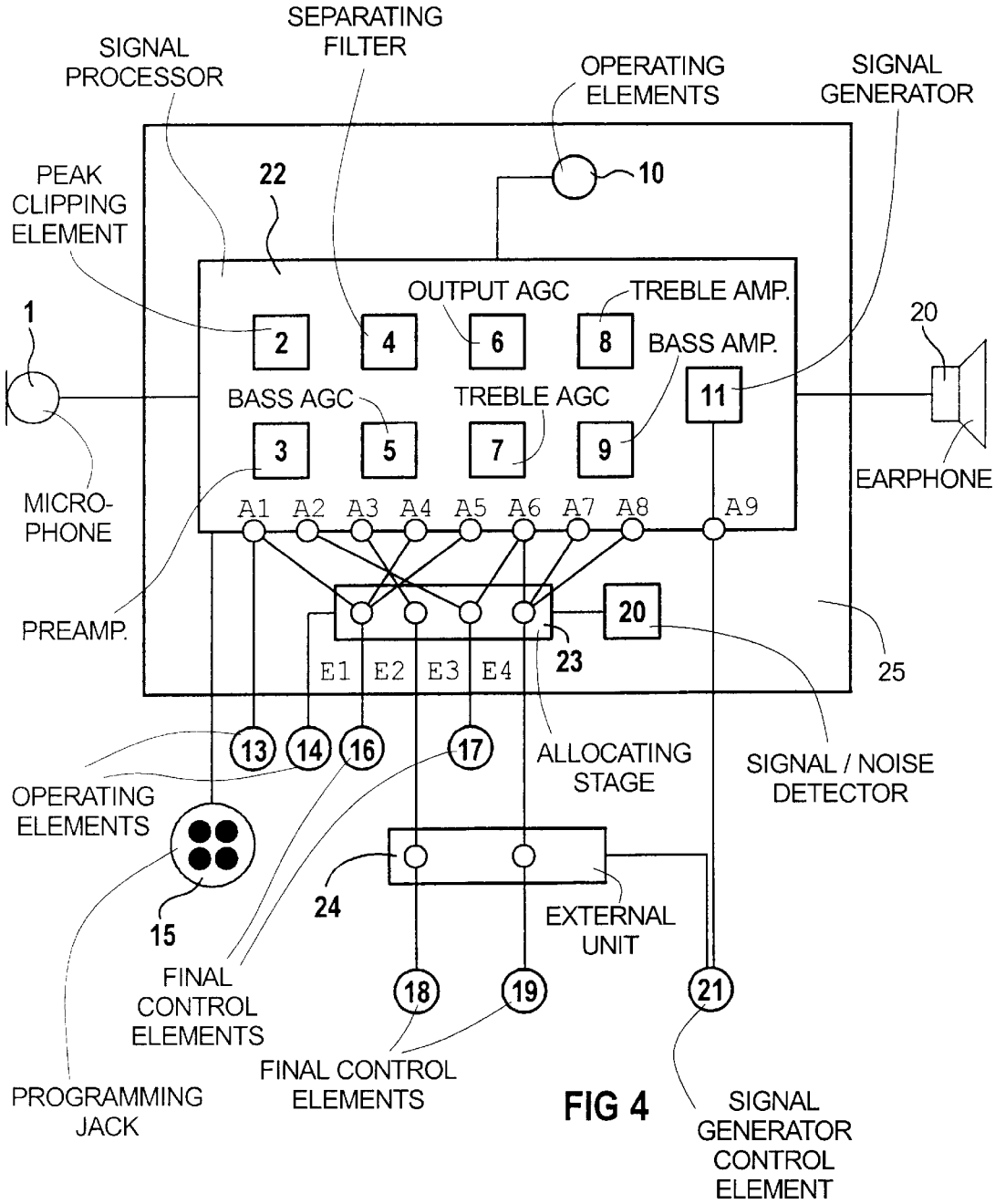
FIG. 4 is a block diagram of an embodiment of an inventive hearing device with a signal generator and a generator control.

FIG. 4 depicts a hearing device with a microphone 1, a signal processor 22 and an earphone 20. The signal processor 22 of the hearing device contains a PC element 2 (Peak Clipping element), a preamplifier 3, a separating filter 4, a bass AGC 5, an output AGC 6, a treble AGC 7, a treble amplifier 8 and a bass amplifier 9. For actuation, output contacts or terminals A1–A8 are connected directly to these components 2–9.

The output contacts A1–A8 of the signal processor 22 can be individually and basically arbitrarily connected to the input contacts E1–E4 of the allocating stage 23 and thus are connected to the final control elements 16 and 17 thereof and are connected indirectly to final control elements 18 and 19 of an external unit 24. The hearing device has further operating elements 10, 13 and 14. A detector element 20 can pick up current useful and noise signals so that the allocation in the allocation stage between the outputs A and the inputs E can be adapted to a current hearing situation. The inventive hearing device also has a signal generator 11 with a signal generator controller 21 which is connected to the processor 22 via the output A9. The signal generator controller 21 is also connected to the external unit 24.

In the in-situ programming the microphone 1 is turned off and tone signals, noise signals, or noise pulse signals are generated by the generator 11 at a defined generator signal level set via the control element 21.

The acoustician can now modify the effect of the signal processor 22 on the signal emitted by the signal generator 11 by gradual adjustment of the final control elements 18 or 19 (if the external unit 24 is used). By responding, the user can make it known whether the signal from the earphone 20 is audible or (un)comfortable. When an acceptable signal from the earphone 20 is obtained, the corresponding parameters (groups of parameters) such as amplification in the individual channels, AGC settings, dynamic values, discomfort threshold, etc. can be maintained and stored, or computed via existing algorithms and stored.

Alternatively given different signal levels from the signal generator 11 set via the control element 21 all the user-specific parameters (groups of parameters) of the hearing device can be gradually set via the control elements 16 and 17 with continuous response from the user to the acoustician. The external unit 24 then need not be used.

Groups of parameters can be computed and/or set with the allocating stage 23 by a few final control elements, e.g. the final control elements 16 and 17, and/or 18 and 19. The number of the final control elements required for basic programming/reprogramming is thereby reduced and user-friendliness is improved. If desirable or necessary, an external EDP unit can be connected to the signal processor 22 via a programming jack 15 for (supplementary) programming.

Although modifications and changes may be suggested by those skilled in the art, it is the intention of the inventors to embody within the patent warranted hereon all changes and modifications as reasonably and properly come within the scope of their contribution to the art.

We claim as our invention:

1. A hearing device comprising:

a housing adapted to be worn at an ear of a user;

a microphone which receives incoming audio signals, a signal processor which processes said audio signals, and an earphone for emitting outgoing audio signals;

said signal processor having a plurality of adjustable audiological/acoustical parameters associated therewith which define a manner of processing said audio signals, each of said audiological/acoustical parameters having a terminal associated therewith at said signal processor;

a plurality of individually actuatable final control elements, accessible externally of said housing, for setting said audiological/acoustical parameters; and an allocation stage connected between said terminals of said signal processor and said final control elements for producing a set of audiological/acoustical parameters defining a manner of processing said audio signals in said signal processor upon actuation of a single one of said final control elements, said set comprising audiological/acoustical parameters selected from the group consisting of combinations of said audiological/ acoustical parameters and parameters derived from said audiological/acoustical parameters.

2. A hearing device as claimed in claim 1 further comprising means for adjusting a content of said set of audiological/acoustical parameters in said allocation stage.

3. A hearing device as claimed in claim 2 comprising programmable means for adjusting said set of audiological/ acoustical parameters in said allocation stage.

4. A hearing device as claimed in claim 2 comprising a detector for detecting current audio signals and noise, said detector being connected to said allocation stage and said allocation stage adjusting said set of audiological/acoustical parameters dependent on at least one of said audio signal and said noise detected by said detector.

5. A hearing device as claimed in claim 1 further comprising an external unit, separate from said housing, containing said final control elements.

6. A hearing device as claimed in claim 5 further comprising a plurality of additional operating elements for said hearing device disposed at said external unit.

7. A hearing device as claimed in claim 5 wherein said external unit comprises a programmable electronic data processor.

8. A hearing device as claimed in claim 1 wherein said allocating stage comprises a storage unit.

9. A hearing device as claimed in claim 8 wherein said storage unit comprises a non-volatile memory.

10. A hearing device as claimed in claim 1 further comprising a signal generator operated by a generator controller, said signal generator being connected to said signal processor and generating a signal for processing by said signal processor during setting of said audiological/acoustical parameters using said final control elements.

11. A hearing device as claimed in claim 10 wherein said signal generator comprises a generator selected from the group consisting of a tone generator, a noise generator, and a noise pulse generator.

12. A hearing device as claimed in claim 10 wherein said generator controller has a generator controller control element which is accessible externally of said housing.

13. A hearing device as claimed in claim 1 wherein said final control elements comprise a first group of final control elements, and said hearing device further comprising at least one additional final control element, not contained in said group of final control elements, which is externally accessible and is directly connected to said signal processor for setting a user-specific set of said audiological/acoustical parameters.

14. A hearing device as claimed in claim 13 wherein said first group of final control elements and said at least one additional final control element are disposed at an external unit, remote from said housing.

15. A hearing device as claimed in claim 1 further comprising a programming jack, accessible externally of said housing and connected directly to said signal processor, adapted for connection of an external data processor to said signal processor.

16. A method for operating a hearing device comprising the steps of:

providing a housing adapted to be worn at an ear of a user;

receiving incoming audio signals in said housing, processing said audio signals in said housing using a plurality of adjustable audiological/acoustical parameters which define a manner of processing said audio signals, each of said audiological/acoustical parameters having a terminal associated therewith at a signal processor in which the processing is conducted, and emitting outgoing audio signals from said housing;

providing a plurality of individually actuatable final control elements, accessible externally of said housing, for setting said audiological/acoustical parameters; and connecting an allocation stage between said terminals of said signal processor and said final control elements for producing a set of audiological/acoustical parameters defining said manner of processing said audio signals in said signal processor by actuating a single one of said final control elements, said set comprising audiological/acoustical parameters selected from the group consisting of combinations of said audiological/acoustical parameters and parameters derived from said audiological/acoustical parameters.

17. A method as claimed in claim 16 further comprising adjusting a content of said set of audiological/acoustical parameters in said allocation stage.

18. A method as claimed in claim 17 comprising adjusting said set of audiological/acoustical parameters in said allocation stage by programming.

19. A method as claimed in claim 17 comprising detecting current audio signals and noise, adjusting said set of audiological/acoustical parameters in said allocation stage dependent on at least one of the detected audio signal and said noise.

20. A method as claimed in claim 16 comprising disposing said final control elements at an external unit, separate from said housing.

21. A method as claimed in claim 20 comprising providing a plurality of additional operating elements for said hearing device at said external unit.

22. A method as claimed in claim 20 comprising providing a programmable electronic data processor as said external unit.

23. A method as claimed in claim 16 comprising providing a storage unit as said allocating stage.

24. A method as claimed in claim 23 comprising providing a non-volatile memory as said storage unit.

25. A method as claimed in claim 16 comprising generating a signal using a signal generator in said housing for processing by said signal processor during setting of said audiological/acoustical parameters using said final control elements.

26. A method as claimed in claim 25 comprising selecting said signal a generator from the group consisting of a tone generator, a noise generator, and a noise pulse generator.

27. A method as claimed in claim 25 comprising providing a generator controller for controlling said signal generator and disposing a generator controller control element, for operating said generator controller, so as to be accessible externally of said housing.

28. A method as claimed in claim 27 comprising disposing said first group of final control elements and said at least one additional final control element at an external unit, remote from said housing.

29. A method as claimed in claim 16 wherein said final control elements comprise a first group of final control elements, and said method further comprising providing at least one additional final control element, not contained in said group of final control elements, which is externally accessible and directly connecting said at least one additional final control element to said signal processor for setting a user-specific set of said audiological/acoustical parameters.

30. A method as claimed in claim 16 further comprising providing a programming jack, accessible externally of said housing and connected directly to said signal processor, adapted for connection of an external data processor to said signal processor.

* * * * *